US007412749B2

(12) United States Patent
Thomas et al.

(10) Patent No.: US 7,412,749 B2
(45) Date of Patent: Aug. 19, 2008

(54) VACUUM CLEANER AND FLOOR DUSTPAN SYSTEM

(75) Inventors: Joyce Thomas, Lexington, IL (US); Michael Oetting, Lexington, IL (US)

(73) Assignee: Euro-Pro Operating, LLC, West Newton, MA (US)

( * ) Notice: Subject to any disclaimer, the term of this patent is extended or adjusted under 35 U.S.C. 154(b) by 724 days.

(21) Appl. No.: 11/042,413

(22) Filed: Jan. 24, 2005

(65) Prior Publication Data

US 2006/0162117 A1 Jul. 27, 2006

(51) Int. Cl.
*A47L 5/24* (2006.01)
*A47L 9/20* (2006.01)
*A47L 9/10* (2006.01)

(52) U.S. Cl. ..... 15/344; 15/347

(58) Field of Classification Search ..... 15/344, 15/347, 350, 352
See application file for complete search history.

(56) References Cited

U.S. PATENT DOCUMENTS

| | | | | |
|---|---|---|---|---|
| 3,708,962 | A | 1/1973 | Deguchi et al. | |
| 4,225,814 | A | 9/1980 | Gantz et al. | |
| 4,573,234 | A | 3/1986 | Kochte et al. | |
| 4,573,237 | A * | 3/1986 | Kochte et al. | 15/344 |
| 4,745,654 | A * | 5/1988 | Yamamoto et al. | 15/344 |
| 5,205,013 | A | 4/1993 | Lopes | |
| 5,560,077 | A | 10/1996 | Crotchett | |
| 5,904,160 | A * | 5/1999 | Wright | 134/21 |
| 5,966,774 | A | 10/1999 | Bone et al. | |
| 6,058,560 | A | 5/2000 | Gab et al. | |
| 6,671,924 | B1 | 1/2004 | Rood | |
| 7,329,295 | B2 * | 2/2008 | Greene et al. | 55/337 |
| 7,341,611 | B2 * | 3/2008 | Greene et al. | 55/337 |
| 2005/0198771 | A1 * | 9/2005 | Min et al. | 15/353 |
| 2007/0271724 | A1 * | 11/2007 | Hakan et al. | 15/329 |

* cited by examiner

*Primary Examiner*—David B Thomas
(74) *Attorney, Agent, or Firm*—Greenberg Traurig LL; Michael I. Wolfson

(57) ABSTRACT

A vacuum cleaner with a self-cleaning filter and a sweeper stand that also functions as an electric dustpan when the vacuum is seated within the sweeper stand is provided. The vacuum includes a housing having an air inlet at one end of the housing and a handle at the other end of the housing. An air passageway includes a deflector to direct dirt into a dirt collection tray which is pivotably mounted to the housing. A filter mounted on the motor divider wall and a filter cleaning arch mounted on the dirt collection tray so that the filter cleaning arch strikes the filter to dislodge dirt collected on the filter as the dirt collection tray pivots open. The sweeper stand includes a housing for receiving the hand vacuum, an opening for directing dirt laden air into an air inlet of the hand vacuum. Power switches to actuate the hand vacuum when the hand vacuum is seated in the sweeper stand are provided.

9 Claims, 9 Drawing Sheets

VACUUM CLEANER AND FLOOR DUSTPAN SYSTEM

BACKGROUND OF THE INVENTION

The invention relates generally to vacuum cleaners, and more particularly to a hand vacuum with a self-cleaning filter and a sweeper stand that functions as an electric dustpan when the hand vacuum is seated within the sweeper stand. The hand vacuum can also be converted to a stick vacuum with the attachment of a nozzle at the suction end and a floor handle at the other end.

Vacuum cleaners are well known and a common household appliance. Most hand vacuum cleaners are light-weight units with a suction opening at one end and a hand grip at the other. The nozzle end includes a collection bin. The nozzle is generally separate from the hand grip typically part of a housing enclosing the vacuum motor.

Most vacuum cleaners include filters. Some vacuum cleaners have the facility for jarring and/or vibrating a vacuum filter to dislodge dirt from the filter. For example, U.S. Pat. No. 3,708,962 to Deguchi et al. discloses a vacuum cleaner including a vibration generator for removing dust from the filter by using the suction force of the vacuum cleaner.

Hand vacuum cleaners that are battery operated or have a power supply cord are well known. Battery operated vacuum systems may have a battery recharging base. For example, U.S. Pat. No. 5,560,077 to Crotchett discloses a wheeled vacuum housing with a separate ramped recharging base. The vacuum system may also include hand-vacuums, such as disclosed in U.S. Pat. Nos. 4,225,814 and 4,573,234. The rechargeable base allows the user to vacuum without worrying if there are electric outlets available around the area to be vacuumed.

Hand vacuums are particularly useful for cleaning household items and hard to reach areas. Various types of hand vacuums are known in the art. Some hand vacuums operate on rechargeable batteries while other hand vacuums have power supply cords. For example, U.S. Pat. No. 4,225,814 to Gantz discloses a storing and recharging base for a hand-held vacuum unit. To prevent dirt spillage from the nozzle and nozzle fouling rechargeable hand vacuums are held on the recharging unit in a position where the nozzle is pointing upwards as disclosed in U.S. Pat. No. 4,573,234 to Kochte. Other hand vacuum cleaners may have a portion of the housing of the vacuum cleaner pivotally connected to the remainder of the housing. For example, U.S. Pat. No. 5,966,774 to Bone et al. discloses a hand-held vacuum that has a first and second portion that can be pivotally separated where one portion moves below the other portion to provide a chute to guide dirt emptied from the filter.

Electric dustpans have been used to suction dirt swept by a broom are known in the art. For example, U.S. Pat. No. 6,671,924 to Rood discloses a dustpan with an inlet that includes an apron that extends outwardly from the inlet with an inclined surface to direct swept debris toward the inlet. Similarly, U.S. Pat. No. 6,058,560 to Gab, shows a trash device with a floor dustpan and U.S. Pat. No. 5,205,013 to Lopes shows a decorative storage housing with a floor suction opening.

Notwithstanding the wide variety of hand vacuums and electric dustpans available, there exists the need to provide continued improvements and alternative designs to improve hand vacuums and electric dustpans that are economical to use, simple in design and easy for the user to operate and in this case, provide a combination hand vacuum and electric dustpan system for a vacuum cleaner.

SUMMARY OF THE INVENTION

Generally speaking, in accordance with the invention, a vacuum cleaner having a nozzle at one end and a hand grip at the other end with a pivotably openable dirt collection tray at the bottom for ease of cleaning is provided. The hand vacuum cleaner includes a self-cleaning filter that is agitated to release entrained dirt by a filter arch as the collection tray is opened for cleaning. The hand vacuum cleaner is mountable in a floor-mounted sweeper stand with the vacuum nozzle engaging an opening facing the floor in the sweeper stand so that the unit can function as an electric dustpan.

Accordingly, it is an object of the invention to provide an improved hand vacuum cleaner.

Another object of the invention is to provide an improved hand vacuum cleaner with a pivotable dirt collection tray that opens to the bottom for emptying the vacuum.

A further object of the invention is to provide an improved hand vacuum cleaner with a self-cleaning filter that is cleaned as the dirt collecting tray pivots open.

It is another object of the invention to provide an improved hand vacuum cleaner with a self-cleaning filter that includes a dirt collection tray pivotally connected to the hand vacuum housing to easily remove dirt from the dirt collection tray.

It is a further object of the invention to provide an improved hand vacuum cleaner that fits into a sweeper stand that functions as an electric floor dustpan when the hand vacuum is seated within the sweeper stand.

Yet another object of the invention is to provide a hand vacuum cleaner that readily converts to a stick vacuum by mounting a floor nozzle at the nozzle end and inserting a pipe handle in the hand grip.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is had to the following description taken in connection with the accompanying drawing(s), in which.

DETAILED DESCRIPTION OF THE INVENTION

Figure 1:
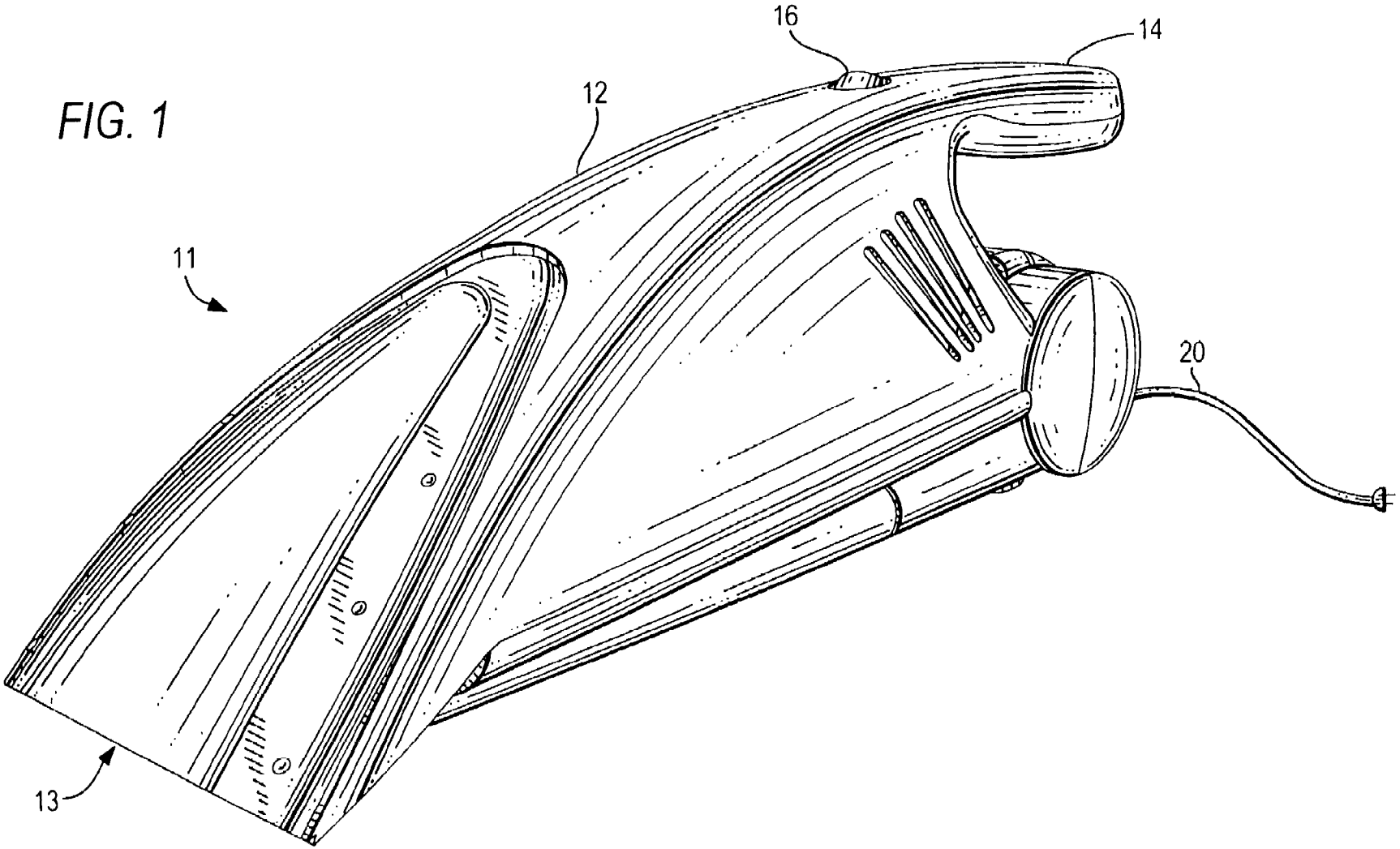
FIG. 1 is a perspective view of a hand vacuum cleaner constructed and arranged in accordance with the invention.

FIG. 1 is a perspective view of a hand vacuum 11 having a unitary elongated housing 12 with an air inlet or nozzle opening 13 at one end and a hand grip 14 at the opposite end. Hand vacuum 11 is powered by a vacuum motor 30 positioned in a motor compartment 27 at the hand grip end. As shown in detail in FIG. 2A, housing 12 is defined by an upper wall 12*a* that runs from nozzle end 13 to hand grip 14 and a lower wall 12*b*. A hand grip wall 12*c* connects upper wall 12*a* and lower wall 12*b*. A portion of lower wall 12*b* has an electrical connector plate 15 below vacuum motor 30.

The outer portion of motor compartment 27 is defined by upper wall 12*a*, lower wall 12*b* and hand grip wall 12*c* and is separated from nozzle 13 by a divider wall 23. Divider wall 23 runs from upper wall 12*a* to lower wall 12*b* of housing 12 with an opening or vent 22 allowing air entering nozzle opening 13 to communicate with motor compartment 27. Motor 30 for hand vacuum 11 is connected to a power source by an electric cord 20. A power switch 16 is located on housing 12 at hand grip 14 for ease of use.

Housing 12 includes a nozzle passageway 13*a* that is formed by top wall 12*a* of housing 12 and an intermediate lower wall 18. A deflector 19 is positioned at the end of passageway 13*a* opposite nozzle opening 13 that extends downward from top wall 12*a* before divider wall 23.

A flap 60 pivotably attaches to lower wall 18 at the interior end of passageway 13*a*, opens to allow air with entrained dirt to travel into enclosure and closes to prevent dirt from falling down air passageway 13*a* when the suction is turned off.

A dirt collection tray 21 forms the bottom front portion of housing 12. Dirt collection tray 21 is pivotably connected to lower wall 12*b* of housing 12 by a pin 29 to form a hinge and held closed by a latch 28. Latch 28 is pivotably connected to lower wall 18 by a pin 28*a* to form a hinge. In another embodiment, latch 28 mounted to lower wall 18 is opened by sliding latch 28 towards lower wall 18. In a further embodiment, latch 28 is mounted to the outer surface of dirt collection tray 21 by a rib so that the latch 28 could slide towards dirt collection tray 21 to release from housing 12. In addition, note that in another embodiment, dirt collection tray 21 may be pivotably connected to lower wall 12*b* of housing by two pins—one on each side of the dirt collection tray 21. A filter unit 24 is mounted at one end to a divider wall 23 above a vent 22. A filter cleaning arch 26 positioned above filter unit 24 is mounted to dirt collection tray 21 so that it moves with the dirt collection tray 21 as it is opened and closed.

Figure 2A:
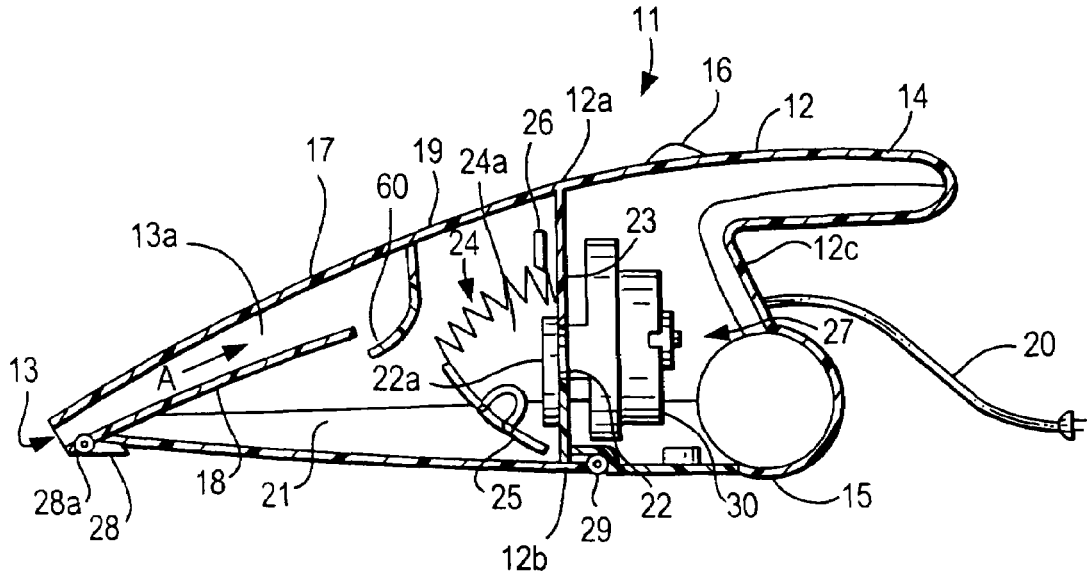
FIG. 2A is a cross-sectional view of the hand vacuum cleaner of FIG. 1 having a pleated filter with the dirt collection tray in the closed position.
Figure 2B:
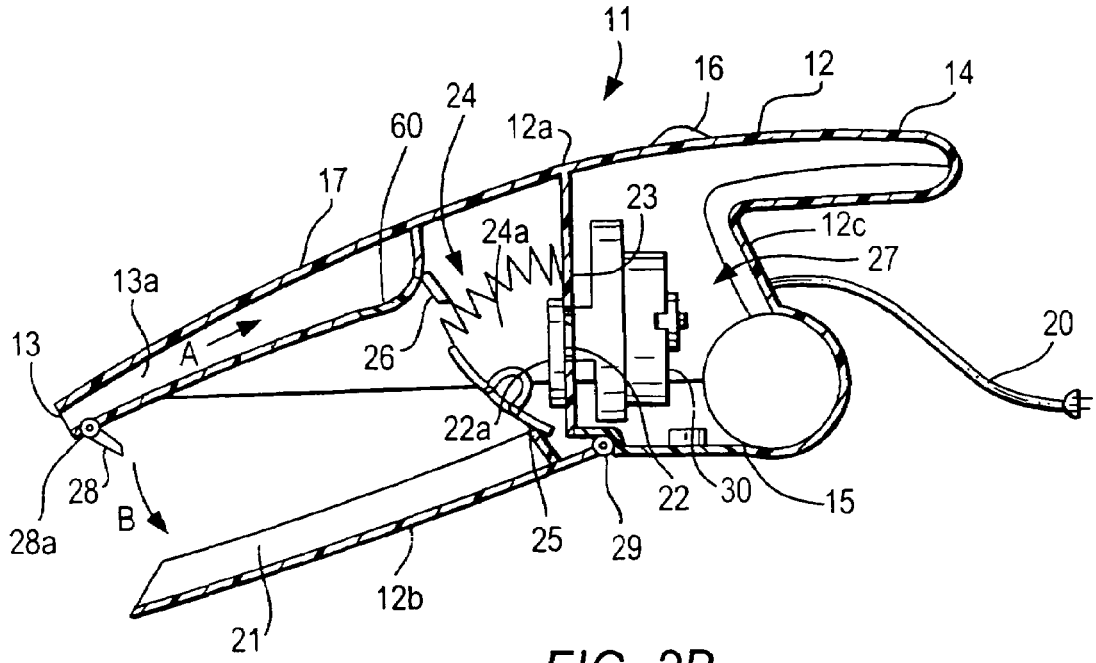
FIG. 2B is a cross-sectional view of the hand vacuum cleaner of FIG. 1 having a pleated filter with the dirt collection tray in the open position.
Figure 5:
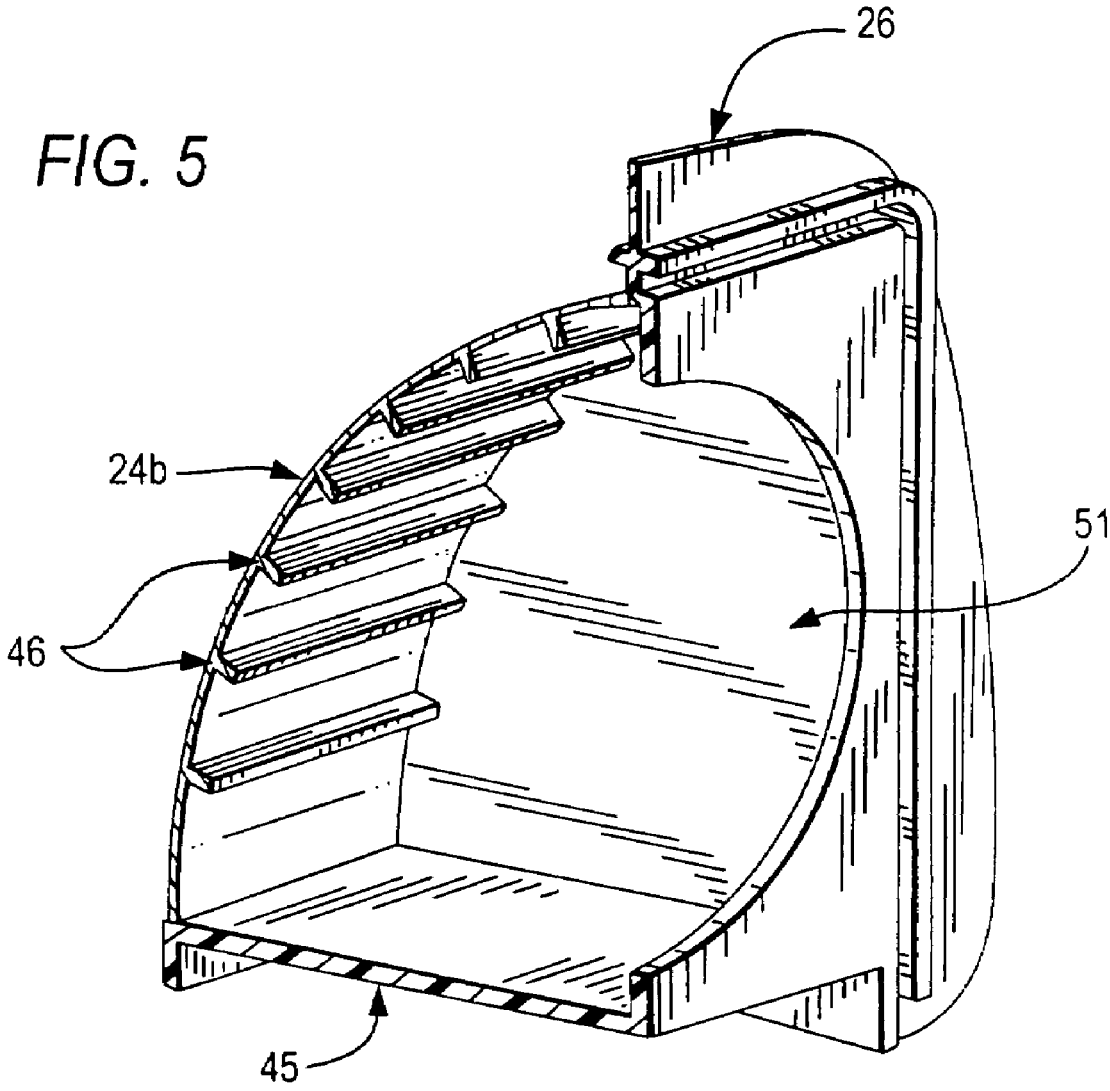
FIG. 5 is a perspective view of a filter unit that includes the filter mounted over the ribbed structure on the filter housing used in the hand vacuum of FIGS. 4A and 4B.

Filter unit 24 includes a filter housing 25 and a filtering material. In one embodiment, the filtering material may be a rigid pleated filter media 24*a* as shown in FIGS. 2A and 2B. One wall of the filtering housing mounts onto and seals against motor divider wall 23 and has an opening 51 (see FIG. 5) that mates with vent 22.

FIG. 2B is a cross-sectional view of hand vacuum cleaner 11 with dirt collection tray 21 in an opened position. Here, it is shown that when hand vacuum 11 is opened to discard dirt from dirt collection tray 21, dirt collection tray 21 pivots open at pin 29 so that dirt collection tray 21 separates from housing 12.

FIGS. 2A and 2B also show the main air flow pattern in housing 12 of vacuum cleaner 11. Dirt laden air enters nozzle opening 13 as shown by arrow A and enters housing 12 through a passageway 13*a*. Air flowing through passageway 13*a* is directed by deflector 19 at the end of passageway 13*a* to help direct dirt in the dirt laden air to a dirt collection tray 21. Air then is drawn through vent 22 in motor divider wall 23. As air is drawn towards vent 22, air with any remaining entrained dirt passes through pleated filter 24*a*. Filter 24*a* further separates dirt from the air before the air is drawn into motor compartment 27. The positioning of filter 24*a* provides a barrier between passageway 13*a* and motor compartment 27 to protect the motor 30.

Figure 3:
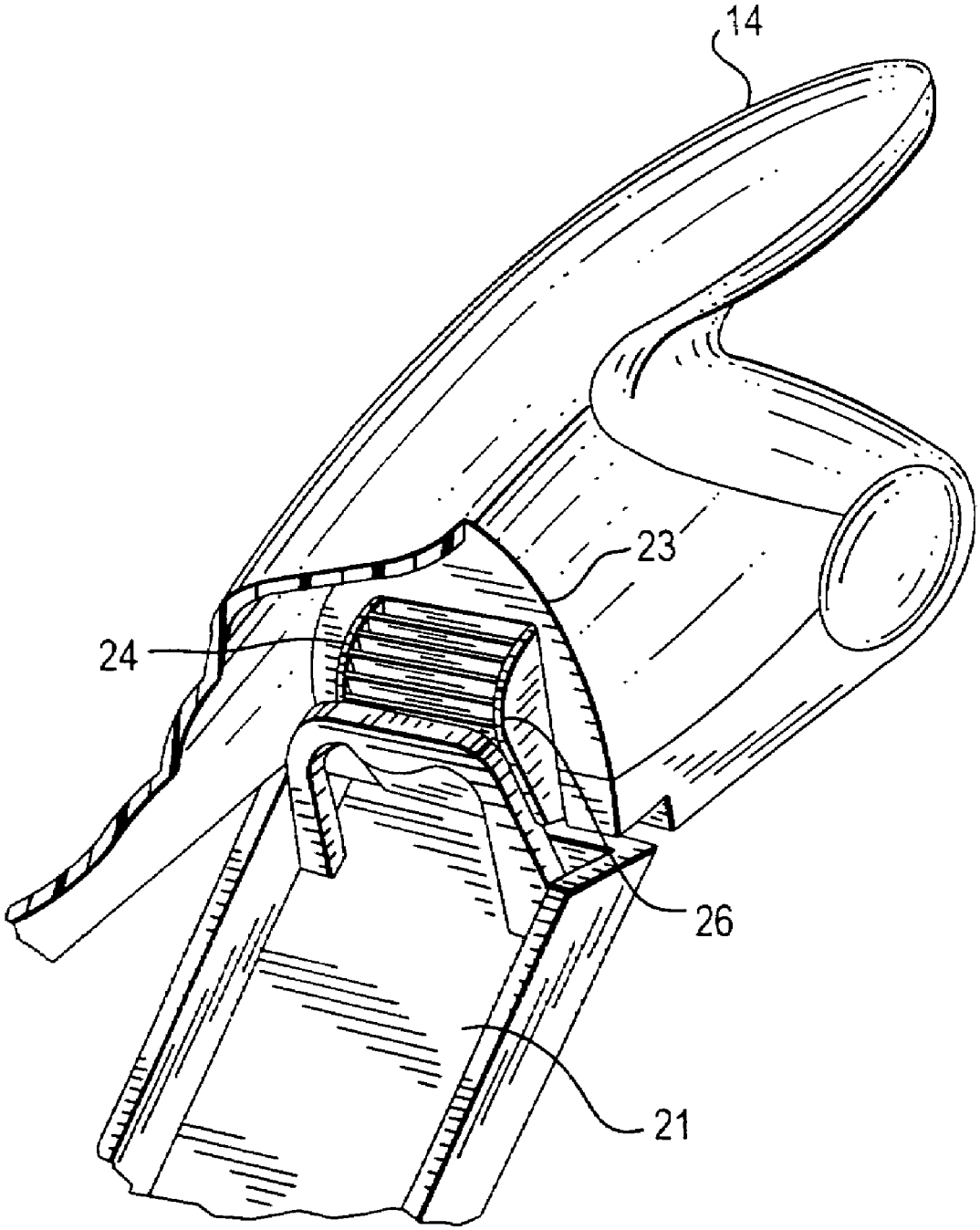
FIG. 3 is a perspective view of the filter cleaning arch used in the hand vacuum of FIGS. 1 and 2.

When a user actuates latch release (not shown) and dirt collection tray 21 pivots open at pin 29 so that dirt collection tray 21 separates from housing 12 as shown by an arrow B in FIG. 2B. As dirt collection tray 21 pivots open, filter cleaning arch 26 is displaced from a first closed position adjacent to divider wall 23 as shown in FIG. 2A to a second open position at the other end of filter 24*a* as shown in FIG. 2B. This movement of filter arch 26 riffling the pleats in filter 24*a* separates any entrained dirt from filter 24*a* and sweeps the dirt onto dirt collection tray 21 to be discarded. Filter cleaning arch 26 is mounted to dirt collection tray 21 is shown more clearly shown in FIG. 3. This construction allows the user to clean filter 24*a* each time vacuum 11 is opened for emptying to discard dirt in an easy and efficient way. Filter 24*a* may also be removed from motor divider wall 23 for a more thorough cleaning or replacement.

Figure 4A:
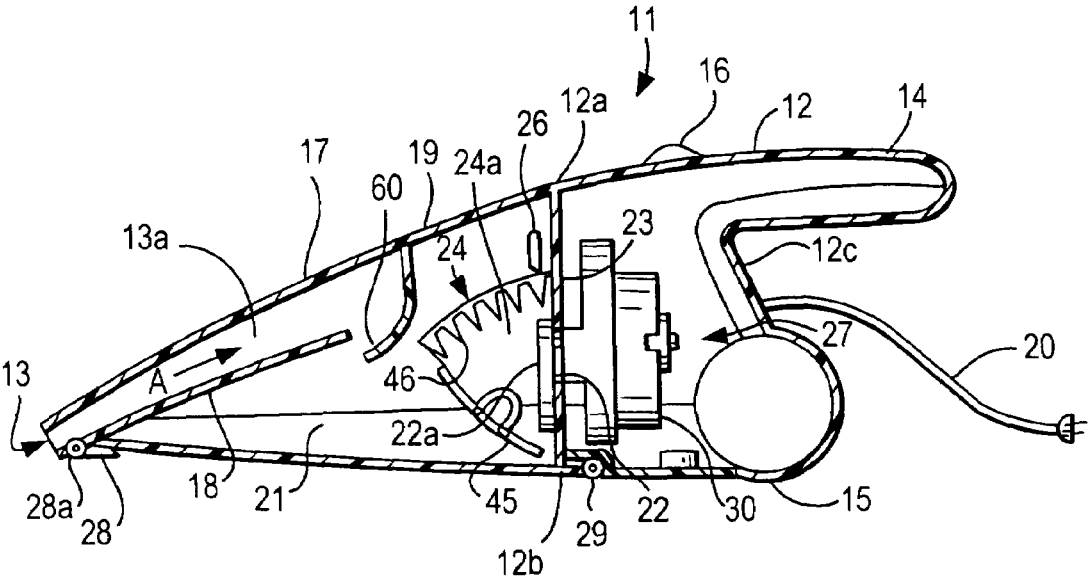
FIG. 4A is a cross-sectional view of the hand vacuum cleaner of FIG. 1 having a filter mounted over a ribbed structure on a filter housing with the dirt collection tray in the closed position.
Figure 4B:
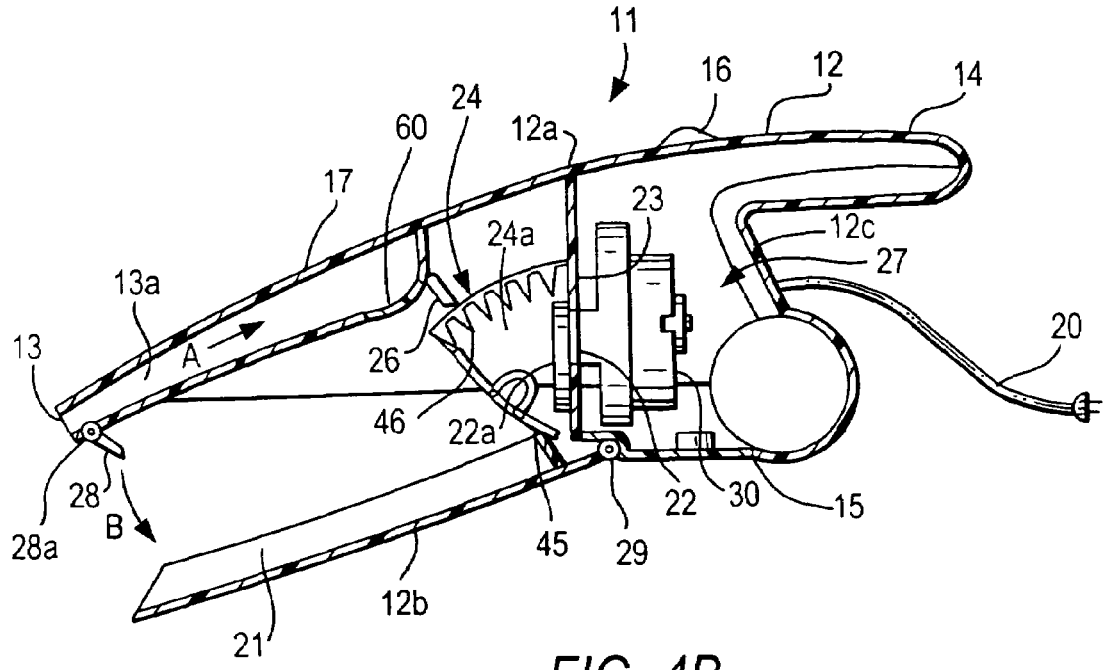
FIG. 4B is a cross-sectional view of the hand vacuum cleaner of FIG. 1 having a filter mounted over the ribbed structure on the filter housing with the dirt collection tray in the open position.

FIGS. 4A and 4B show another embodiment of the present invention where the filtering material may be a soft filtering material or non-pleated filter 24*b* mounted over a ribbed structure 46 on filter housing 45 as shown in FIG. 4A and 4B. FIG. 4A shows the dirt collection tray in the closed position while FIG. 4B shows the dirt collection tray in the open position. Here, as dirt collection tray 21 pivots open, filter cleaning arch 26 is displaced from a first closed position adjacent to divider wall 23 as shown in FIG. 4A to a second open position at the other end of non-pleated filter 24*b* as shown in FIG. 4B. This movement of filter arch 26 riffling filter 24*b* mounted on ribbed structure 46 of filter housing 45 separates any entrained dirt from filter 24*b* and sweeps the dirt onto dirt collection tray 21 to be discarded. Filter unit 24 which includes a non-pleated filter 24*b* is shown more clearly in FIG. 5. Here, soft filtering material or non-pleated filter 24*b* is mounted over a ribbed structure 46 on filter housing 45. This construction allows the user to clean filter 24*b* each time vacuum 11 is opened for emptying to discard dirt in an easy and efficient way. Filter 24*b* may also be removed from motor divider wall 23 for a more thorough cleaning or replacement.

In another embodiment of the invention, the front of the nozzle opening 13 is wide and thin and has an oval shaped with a larger opening in the center to allow for picking up larger pieces of debris. Dividers may be positioned in passageway 13*a* connecting the upper wall 12*a* to intermediate lower wall 18 through the length of passageway 13*a* into different sections. This helps to equalize the suction across a wide nozzle width such that the center opening is one section.

In another embodiment of the invention, a pre-motor filter 22*a* may be positioned over vent 22 to extend the life of the motor 30.

Figure 7:
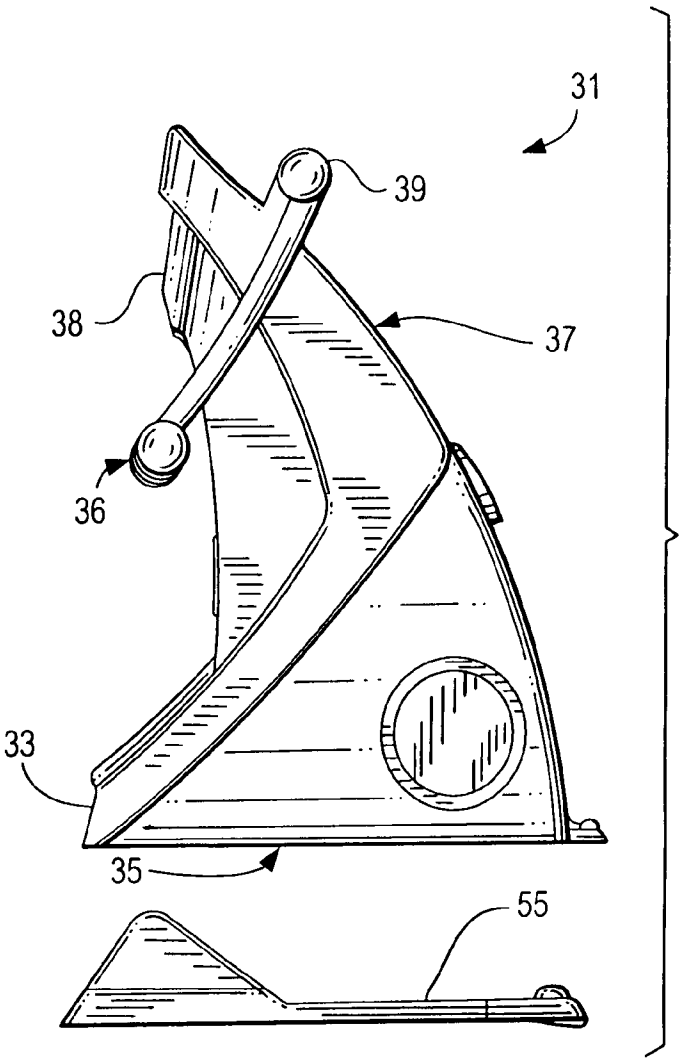
FIG. 7 is a side elevational view of the sweeper stand and recharging unit of FIG. 6.
Figure 6:
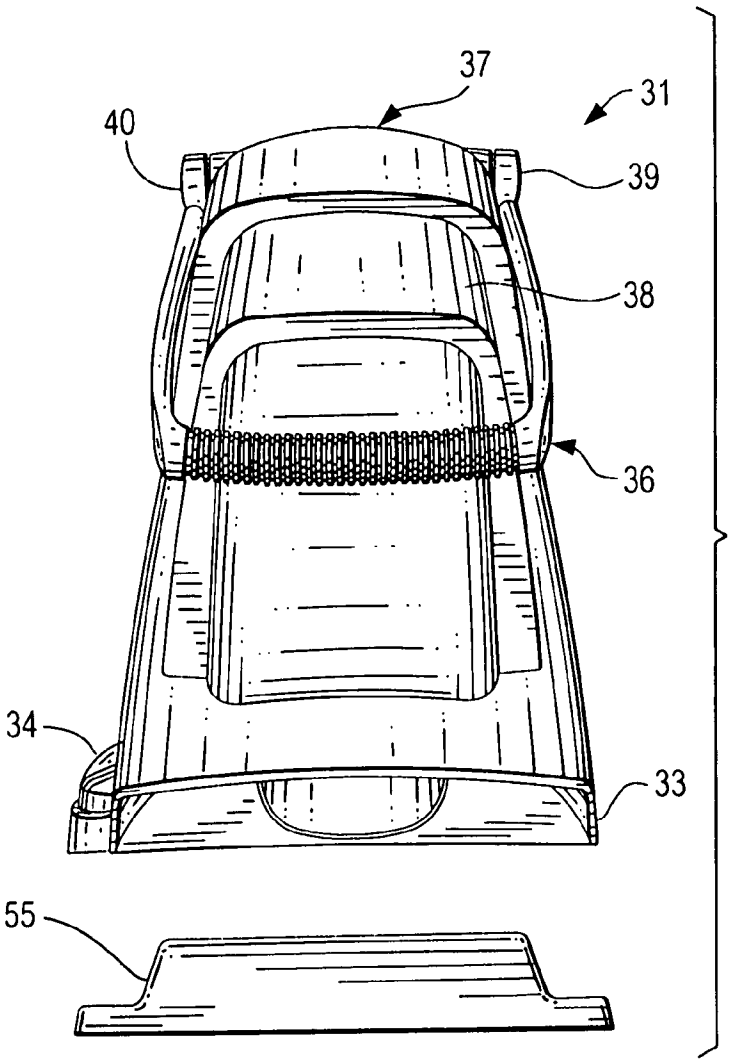
FIG. 6 is a front elevational view of a sweeper stand and recharging unit constructed and arranged in accordance with the invention for use with the vacuum cleaner of FIGS. 1-4.

FIGS. 6 and 7 show front and side elevational views of a sweeper stand and a recharging unit, respectively. Sweeper stand 31 has a vertical housing with a flat bottom 35 designed to sit on the floor or other flat surface. Sweeper stand 31 is configured with a vacuum receiving holder 38 with a vacuum opening 37 for receiving and holding vacuum 11 with nozzle opening 13 facing bottom opening 33. Sweeper stand 31 includes a handle 36 pivotably mounted to upper housing of sweeper stand 31 by a pin 39 and a pin 40 for portability. A floor switch 34 for actuating hand vacuum 11 is mounted at the base of sweeper stand 31. Alternatively, when hand vacuum 11 is battery operated, sweeper stand 31 may be configured to sit on top of recharging unit 55 or sweeper stand 31 may itself include a charging unit so that when hand vacuum 11 is mounted on sweeper stand 31, hand vacuum 11 may be recharged at the same time the electric dustpan is used.

Figure 9:
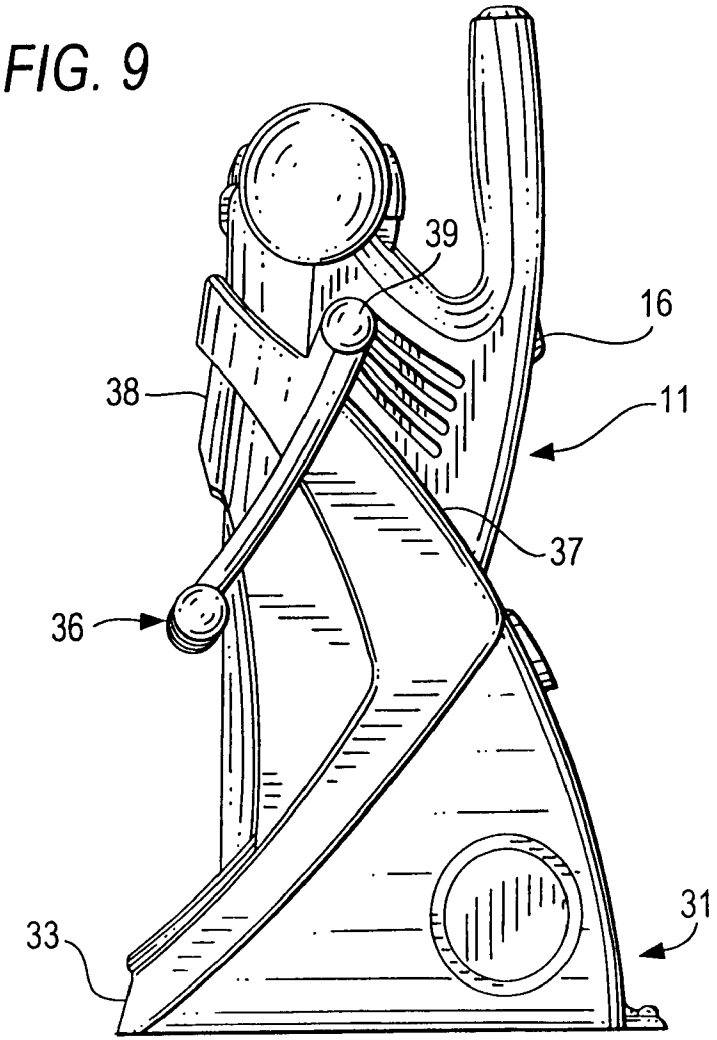
FIG. 9 is a right side elevational view of the hand vacuum in the sweeper stand of FIG. 8.
Figure 8:
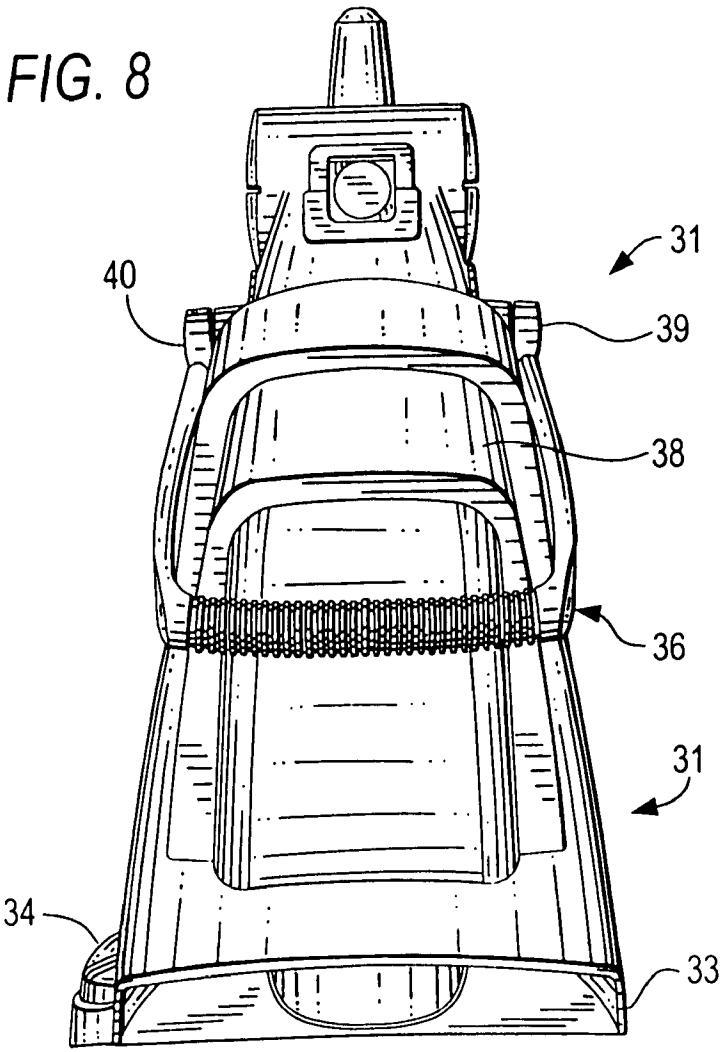
FIG. 8 is a front elevational view of the hand vacuum of FIGS. 1-4 seated within the sweeper stand of FIGS. 6 and 7.

FIGS. 8 and 9 show hand vacuum 11 seated within sweeper stand 31 with nozzle opening 13 in position in sweeper stand 31. When in this position and turned on the combination of hand vacuum 11 and sweeper stand 31 functions as an electric dustpan. Floor switch 34 on sweeper stand 31 bypasses or in the alternative actuates power switch 16 of hand vacuum 11 since sweeper stand 31 has a sweeper electrical connection plate (not shown) located on the inside of vacuum receiving holder 38 that contacts electrical connection plate 15 of hand vacuum 11. When sweeper stand 31 is actuated, hand vacuum 11 provides suction to opening 33 of the sweeper stand 31.

Figure 10:
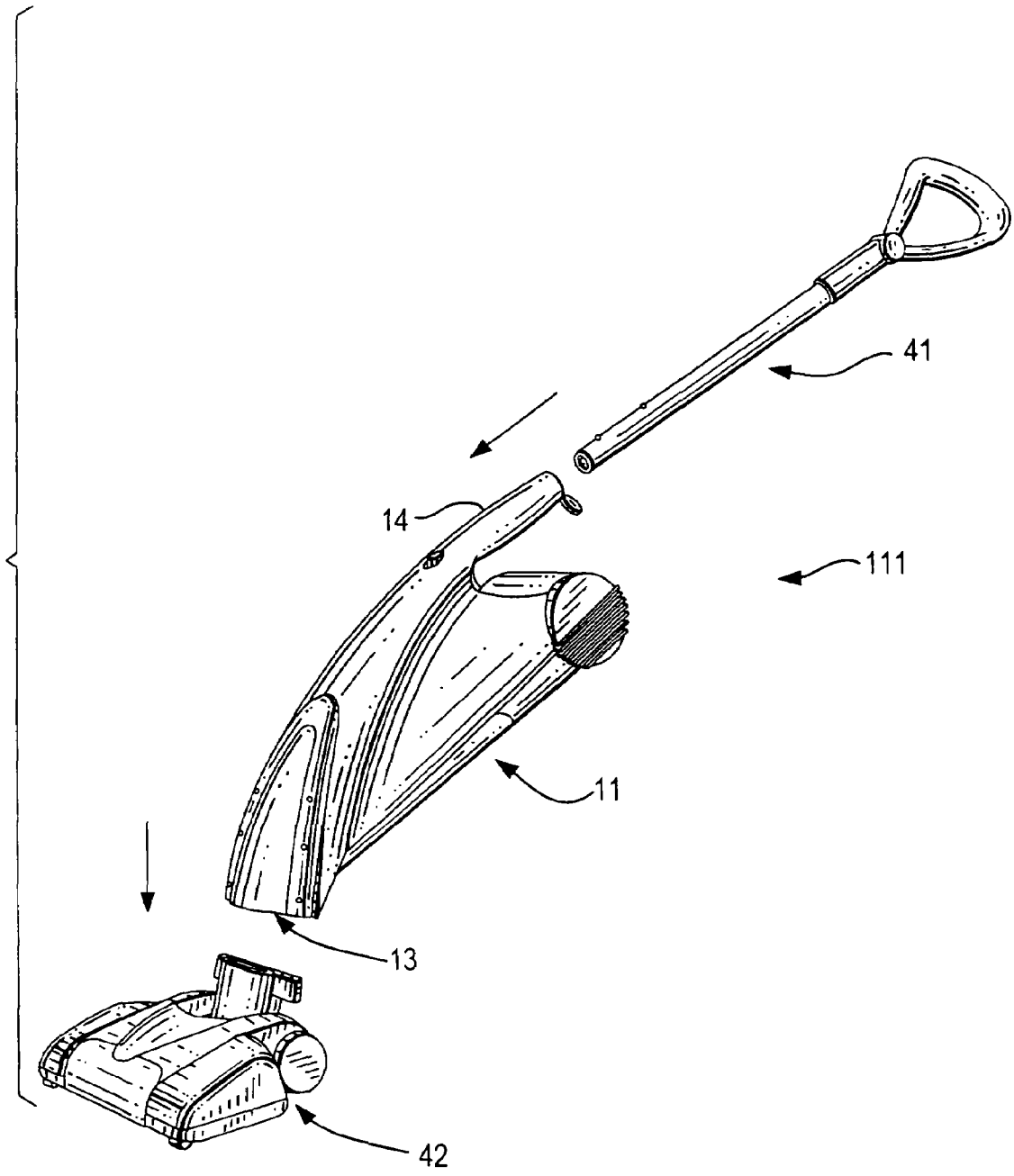
FIG. 10 is an exploded perspective view of the hand vacuum of FIGS. 1-4 showing how the hand vacuum is transformed into a stick vacuum by attaching a pipe handle and nozzle.

FIG. 10 shows how hand vacuum 11 may be easily converted to a stick vacuum 111. A pipe handle 41 is inserted into the end of hand vacuum hand grip 14. A suction nozzle 42 is coupled to air inlet 13 of hand vacuum 11 thereby forming stick vacuum 111 with ease.

Figure 11:
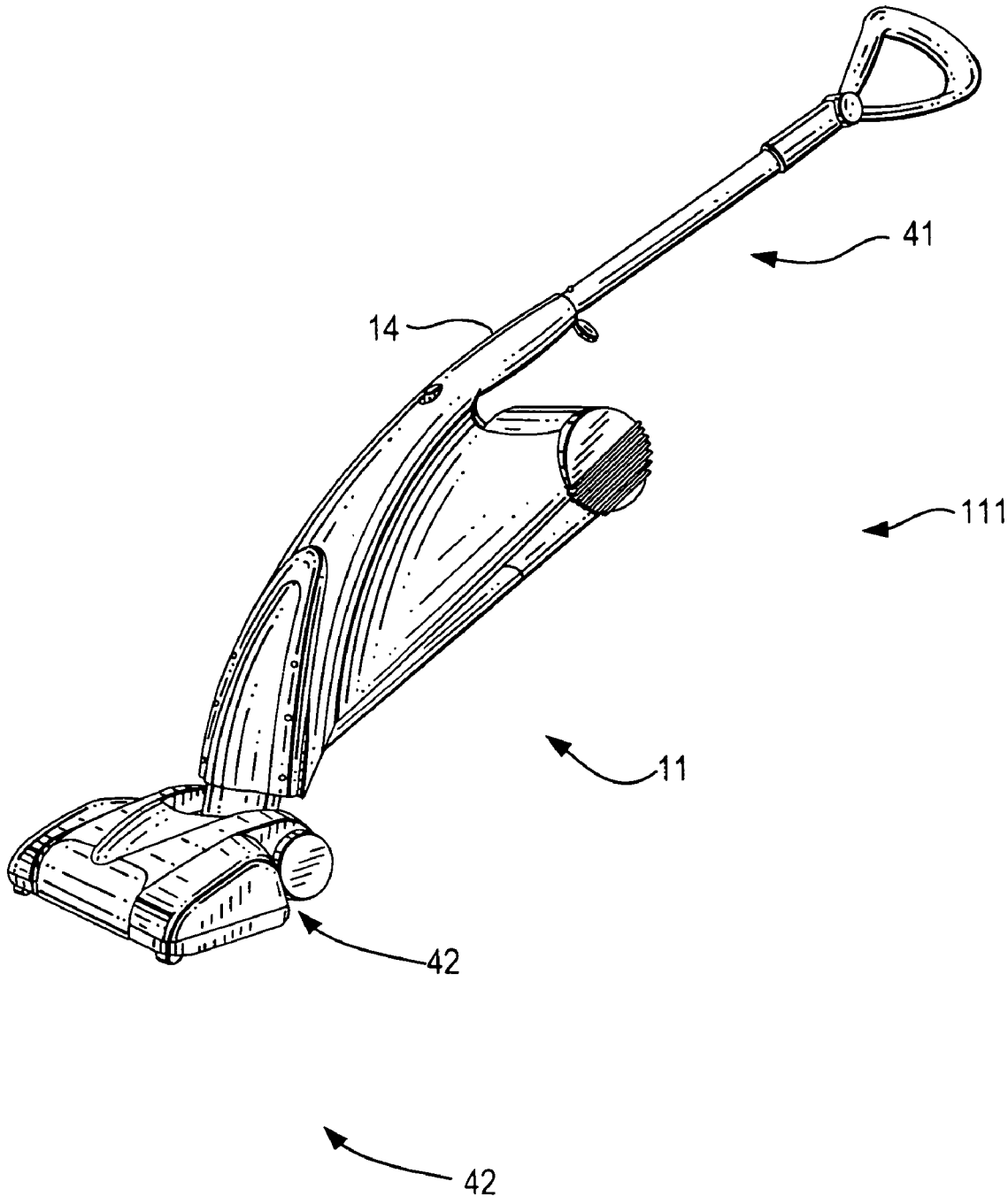
FIG. 11 is a perspective view of the assembled stick vacuum of FIG. 10.

FIG. 11 shows an assembled stick vacuum of FIG. 10.

Air inlet 13 of hand vacuum 11 may be attached to various conventionally used attachments, such as a brush attachment, to tailor hand vacuum 11 for a variety of uses.

In a further embodiment of the invention, hand vacuum 11 may be a battery operated unit. In this case it can be easily recharged in accordance with well known ways. In addition, it may be recharged when placed into a floor recharging unit such as a sweeper stand that includes a charging unit. In this embodiment, sweeper stand would include a charging unit connected to a conventional wall outlet. Alternatively, sweeper stand may be made to fit on top of the recharging unit so that when the hand vacuum is placed on the sweeper stand to be used as an electric dustpan, it may simultaneously be recharged. Additionally, an auxiliary battery pack could be stored and recharged in the lower portion of sweeper stand. This would provide additional run time for a battery-operated unit.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention.

What is claimed is:

1. A vacuum cleaner comprising:

an elongated housing defined by an upper wall, a lower wall and two opposed side walls with a portion of the lower wall defining a dirt collection tray, and an air inlet at one end and a hand grip at the other end;

a motor compartment defined within the housing including a vacuum motor positioned therein;

the dirt collection tray is hingedly connected to a portion of the lower wall of the housing;

an inlet air passageway defined by the upper wall and intermediate inner wall;

a pleated filter mounted in the housing above the pivotable collection tray; and a filter cleaning arch mounted on the dirt collection tray;

wherein upon opening the dirt collection tray, the filter cleaning arch strikes the pleats of the pleated filter to dislodge dirt collected on the filter as the dirt collected in the dirt collection tray is emptied.

2. The vacuum cleaner of claim 1, wherein the inlet air passageway includes a deflector that extends downward from the upper housing at the end of the passageway to direct dirt downwardly towards the dirt collection tray.

3. The vacuum cleaner of claim 1, wherein a second filter surrounds the pleated filter.

4. The vacuum cleaner of claim 1, further including a power cord.

5. The vacuum cleaner of claim 1, further including a rechargeable battery housing below the vacuum handle for holding rechargeable batteries.

6. The vacuum cleaner of claim 1, wherein the air passageway is divided in three sections across the length of the air passageway.

7. The vacuum cleaner of claim 1, further including a cooperating sweeper stand for storing the vacuum cleaner when not in use, the sweeper stand having a base with a horizontal opening, configured to hold the vacuum cleaner substantially vertical with its air inlet at the opening of the sweeper stand.

8. The vacuum cleaner of claim 1, further including a vacuum floor nozzle mountable at the nozzle opening for converting the vacuum cleaner to a stick vacuum.

9. The vacuum cleaner of claim 8, further including a pipe handle for mounting to the vacuum handle to extend the height of the vacuum cleaner.

* * * * *